US011771299B2

(12) United States Patent
Wu et al.

(10) Patent No.: US 11,771,299 B2
(45) Date of Patent: Oct. 3, 2023

(54) ROTARY CUP WASHING DEVICE

(71) Applicant: Spark (Xiamen) Sanitary Ware Co., Ltd., Fujian (CN)

(72) Inventors: Zhifeng Wu, Fujian (CN); Huilong Shao, Fujian (CN); Kailiang Zhu, Fujian (CN)

(73) Assignee: Spark (Xiamen) Sanitary Ware Co., Ltd., Xiamen (CN)

( * ) Notice: Subject to any disclaimer, the term of this patent is extended or adjusted under 35 U.S.C. 154(b) by 0 days.

(21) Appl. No.: 17/840,450

(22) Filed: Jun. 14, 2022

(65) Prior Publication Data

US 2023/0263361 A1 Aug. 24, 2023

(30) Foreign Application Priority Data

Feb. 22, 2022 (CN) ..... 202220354831.9

(51) Int. Cl.
*A47L 15/00* (2006.01)
*A47L 15/42* (2006.01)
*A47L 15/06* (2006.01)

(52) U.S. Cl.
CPC ..... *A47L 15/0065* (2013.01); *A47L 15/06* (2013.01); *A47L 15/4278* (2013.01); *A47L 2601/16* (2013.01)

(58) Field of Classification Search
None
See application file for complete search history.

(56) References Cited

U.S. PATENT DOCUMENTS 5,522,410 A * 6/1996 Meilleur ..... A47L 15/0065 134/108
2018/0092505 A1* 4/2018 Simon ..... B05B 9/0403

* cited by examiner

*Primary Examiner* — Rita P Adhlakha
(74) *Attorney, Agent, or Firm* — Cooper Legal Group, LLC

(57) ABSTRACT

The present invention discloses a rotary cup washing device, comprising a flushing nozzle, a rotary impeller, a swirl outflow member, a fixed head and a water inlet pipe. The flushing nozzle, the rotary impeller, and the swirl outflow member are all provided in the fixed head. The flushing nozzle is connected to an upper part of the rotary impeller, and a lower part of the rotary impeller is correspondingly matched with the swirl outflow member, the flushing nozzle and the rotary impeller are capable for rotating relative to the fixed head under a water discharge action of the swirl outflow member. A lower part of the fixed head is connected to the water inlet pipe, and the water inlet pipe is connected to a pressure source. The present invention is capable of rotating the water to wash the cup in an omnibearing and uniform manner, and the cleaning effect is better.

11 Claims, 14 Drawing Sheets

ROTARY CUP WASHING DEVICE

RELATED APPLICATIONS

The present disclosure claims priority to Chinese Patent Application No. 202220354831.9, filed on Feb. 22, 2022, which is incorporated herein by reference.

TECHNICAL FIELD

The present disclosure relates to the technical field of cleaning devices, and in particular, to a rotary cup washing device.

BACKGROUND

The cup washing device in the prior art, such as the rotary cup washing machine disclosed in CN206779097, when it is working, the water flow in the fixed head directly flows into the washing head through the connector and then flows out to wash the cup. No component is provided for rectifying the water flow, that is, the shape of the water flow cannot be adjusted, and the flushing head is rotated by the reaction force of the water outlet from the side spray holes. The rotation stability is poor, and it is difficult to thoroughly clean the inside of the cup, such that the cleaning effect is not ideal.

SUMMARY

The present disclosure aims to provide a rotary cup washing device to solve the above-mentioned problems.

For achieving the above object, the technical solution of the present disclosure is:

A rotary cup washing device, comprising a flushing nozzle, a rotary impeller, a swirl outflow member, a fixed head and a water inlet pipe; wherein the flushing nozzle, the rotary impeller and the swirl outflow member are all provided in the fixed head; the flushing nozzle is connected to an upper part of the rotary impeller, a lower part of the rotary impeller is correspondingly matched with the swirl outflow member, the flushing nozzle and the rotary impeller are capable for rotating relative to the fixed head under a water discharge action of the swirl outflow member; a lower part of the fixed head is connected to the water inlet pipe; and the water inlet pipe is connected to a pressure source.

In an embodiment, the flushing nozzle is provided with a water outlet channel, a top of the flushing nozzle is provided with a first flushing hole in communication with the water outlet channel; the rotary impeller is provided with impeller outflow holes corresponding to the water outlet channel; the swirl outflow member is provided with a plurality of swirl outflow holes, and the plurality of swirl outflow holes are in communication with the impeller outflow holes.

In an embodiment, a bottom edge of the rotary impeller is provided with a plurality of baffle blades formed at equal intervals in a circumferential direction.

In an embodiment, the swirl outflow member is a lower swirl outflow member located under the rotary impeller; three swirl outflow holes are provided, the three swirl outflow holes are evenly distributed at an included angle of 120° in a circumferential direction inside a bottom of the lower swirl outflow member, and the plurality of swirl outflow holes are opposite to bottoms of the plurality of baffle blades.

In an embodiment, the swirl outflow member is a peripheral swirl outflow member in a shape of a bottle cap and sleeved on an outer bottom of the rotary impeller; three swirl outflow holes are provided, the three swirl outflow holes are evenly distributed at an included angle of 120° in a circumferential direction outside the peripheral swirl outflow member, and the plurality of swirl outflow holes are opposite to outsides of the plurality of baffle blades.

In an embodiment, the rotary cup washing device further comprises a connecting head connected in the fixed head; the rotary impeller and the swirl outflow member are limited in the fixed head under the connecting head.

In an embodiment, the first flushing hole is a rugby-shaped through hole provided at a top center of the flushing nozzle, and an outer wall of the top center of the flushing nozzle is formed with a triangular pyramid-shaped recess corresponding to the rugby-shaped through hole.

In an embodiment, the top of the flushing nozzle is provided with second flushing holes respectively on both sides of the first flushing hole and in communication with the water outlet channel, and the second flushing holes are inclined outward.

In an embodiment, the rotary cup washing device further comprises a set of cup bracket provided outside the fixed head; the cup bracket comprises a plurality of bearing plates, and upper surfaces of the bearing plates of the cup bracket are provided with a plurality of annular ridges.

In an embodiment, the rotary cup washing device further comprises a water control mandrel connected to the lower part of the fixed head and provided with a water channel; the water inlet pipe is formed with an annular protrusion, an inside of the water inlet pipe is divided into a receiving channel and a water inlet channel by the annular protrusion, the water control mandrel runs through the annular protrusion; one end of the water control mandrel at the water inlet channel is a block end blocked and mated with the annular protrusion, the water control mandrel located on the block end is further provided with a water hole in communication with the water channel; and the water control mandrel located between the fixed head and the annular protrusion is further sleeved with a spring outside.

In an embodiment, the fixed head and the water control mandrel are integrally formed.

The present disclosure has the following beneficial effects:

(1) The present disclosure can form a swirl impact flow to the rotary impeller through the swirl outflow member, thereby driving the rotary impeller and the flushing nozzle to rotate together. The rotation stability is higher, and the rotary impeller can rectify the water flow at the same time. The rectified water flow flows to the flushing nozzle, finally the cup is flushed and cleaned thoroughly through the spray of the flushing nozzle, and the cleaning effect is better.

(2) A connecting head is connected in the fixed head in a thread, the rotary impeller and the swirl outflow member are limited in the fixed head under the connecting head. A seal is provided between the connecting head and the flushing nozzle, the configuration can improve the sealing and reliability, while ensuring the stability of the flushing work.

(3) The first flushing hole in the top center of the flushing nozzle is set as a rugby-shaped through hole, and a triangular pyramid-shaped recess corresponding to the rugby-shaped through hole is formed on the outer wall of the top center of the flushing nozzle. The configuration can enable the water spray from the first flushing hole in the shape of a sheet, the flushing coverage is larger, and the flushing effect is better. The top of the flushing nozzle is provided with second flushing holes on both sides of the first flushing hole, and the second flushing holes are inclined outward symmetrically, such that the flushing space can be further increased, with stronger impact and higher cleanliness.

1, flushing nozzle; 2, rotary impeller; 3, swirl outflow member; 4, fixed head; 5, connecting head; 6, seal; 7, water inlet pipe; 71, annular protrusion; 8, cup bracket; 81, bearing plate; 82, annular ridge; 83, bearing rod; 84, annular groove; 9, water control mandrel; 91, block end; 10, base; 11, receiving channel; 12, water inlet channel; 13, water channel; 14, water outlet channel; 15, baffle blade; 16, first flushing hole; 17, second flushing hole; 18, impeller outflow hole; 19, swirl outflow hole; 20, triangular pyramid-shaped recess; 21, water hole; 22, spring; 23, hollow column; 24, through hole.

DESCRIPTION OF EMBODIMENTS

To further illustrate the various embodiments, the present disclosure provides accompanying drawings. These drawings are a part of the present disclosure, which are mainly used to illustrate the embodiments, and can be combined with the relevant description of the specification to explain the operation principles of the embodiments. With reference to these contents, those of ordinary skill in the art should be able to understand other possible embodiments and the advantages of the present disclosure. Components in the figures are not drawn to scale, and similar component symbols are often used to represent similar components.

Embodiment 1

Figure 1:
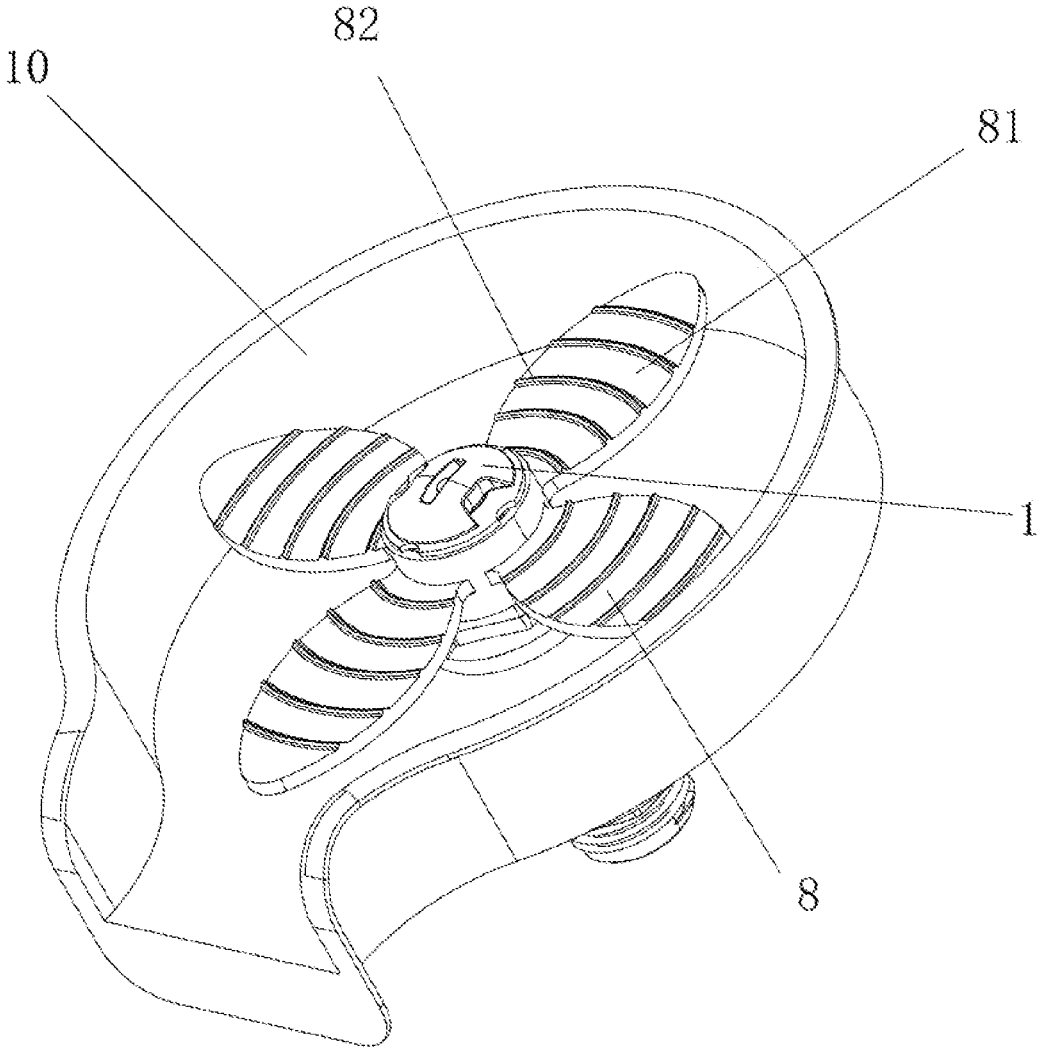
FIG. 1 is a front view of Embodiment 1 according to the present disclosure.
Figure 2:
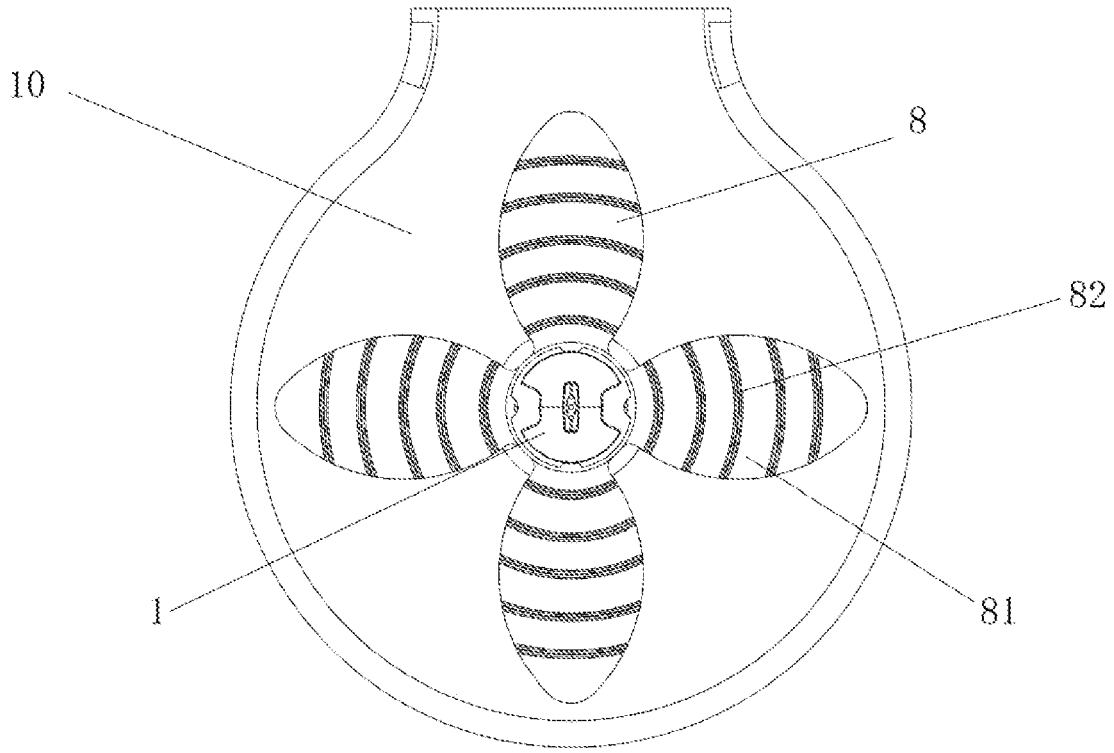
FIG. 2 is a top view of Embodiment 1 according to the present disclosure.
Figure 3:
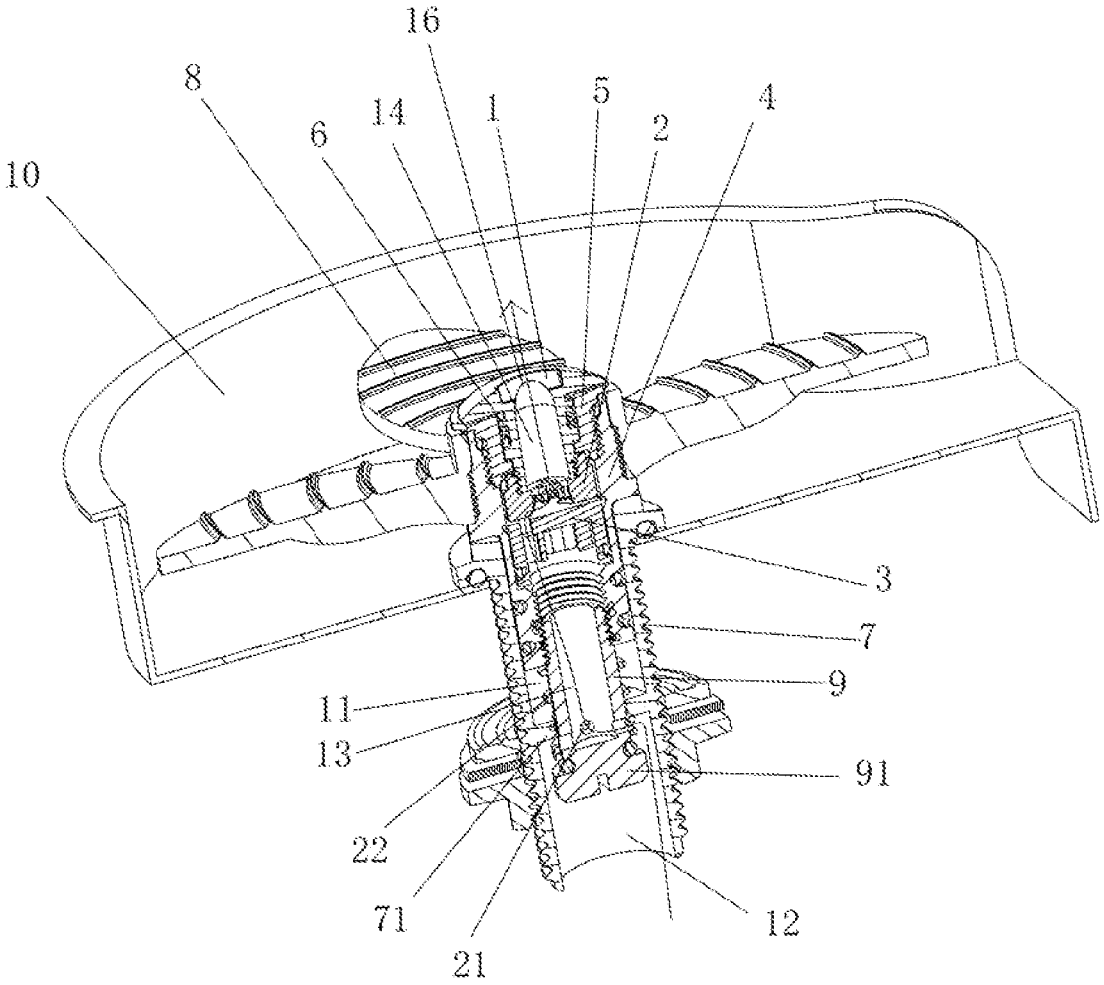
FIG. 3 is a cross-sectional view of Embodiment 1 according to the present disclosure (the line path in the figure is a water outlet path)
Figure 4:
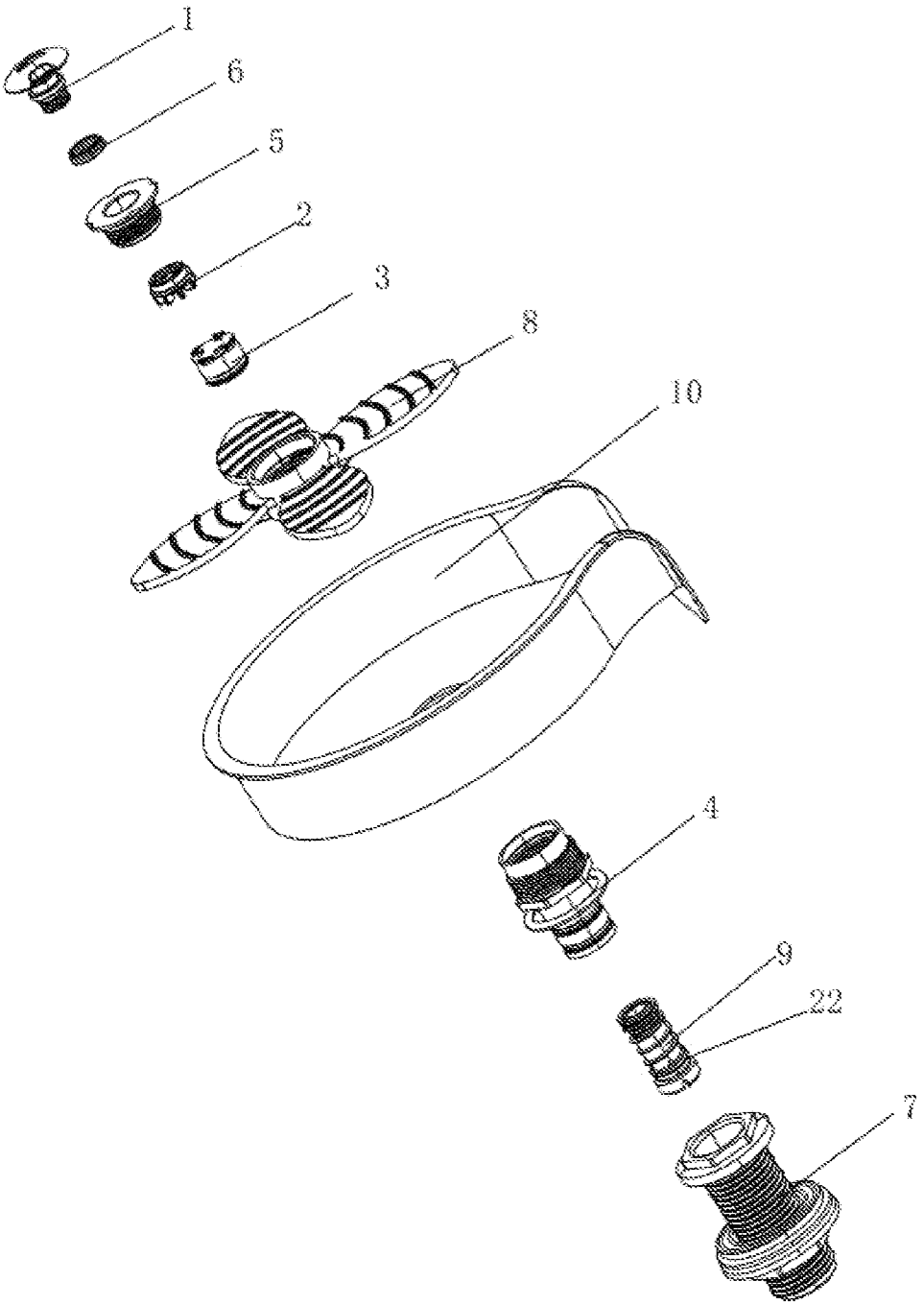
FIG. 4 is an exploded view of Embodiment 1 according to the present disclosure.
Figure 5:
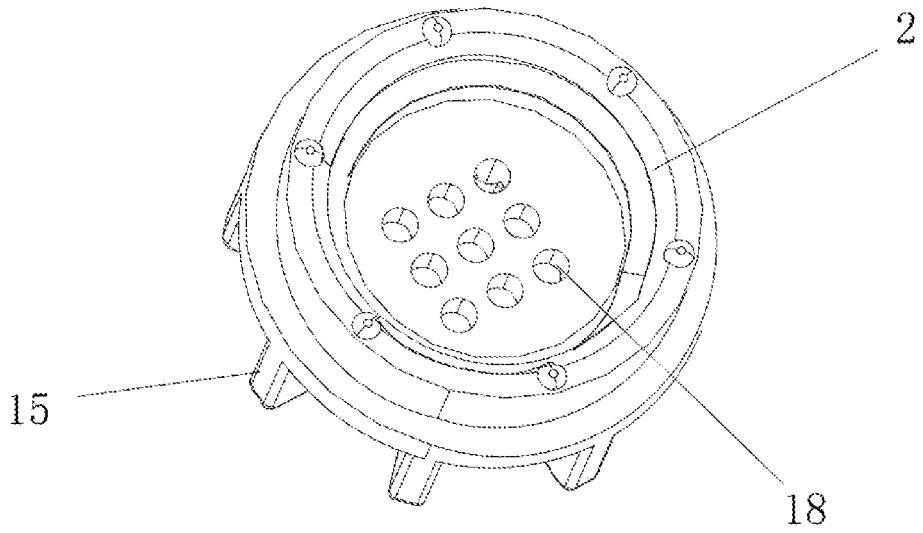
FIG. 5 is a top perspective view illustrating the rotary impeller of Embodiment 1 according to the present disclosure.
Figure 6:
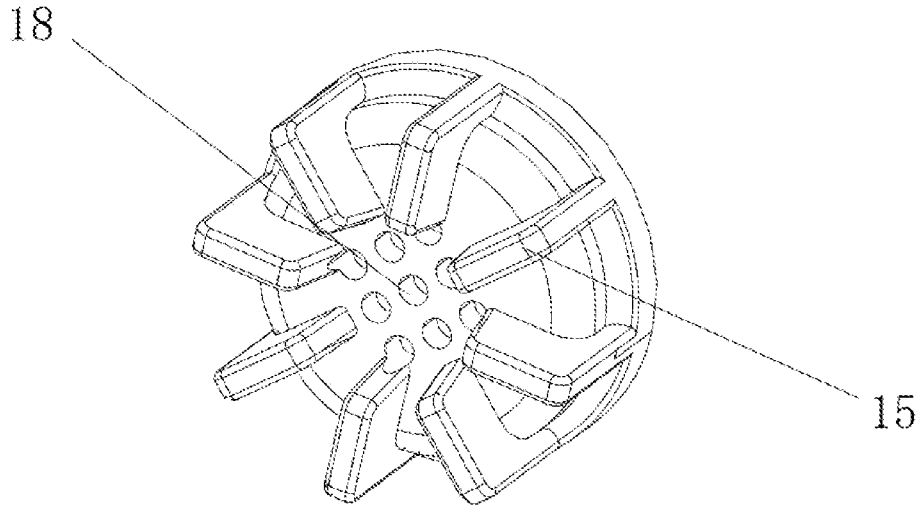
FIG. 6 is a bottom perspective view illustrating the rotary impeller of Embodiment 1 according to the present disclosure.
Figure 7:
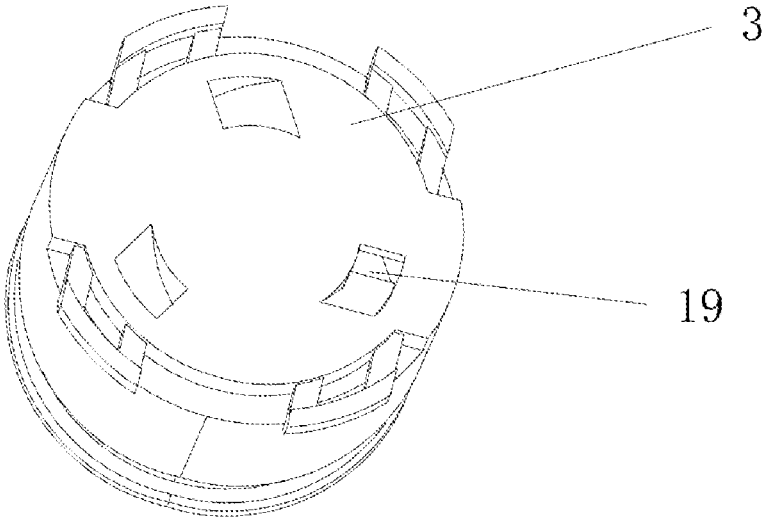
FIG. 7 is a top perspective view illustrating a lower swirl outflow member of Embodiment 1 according to the present disclosure.
Figure 8:
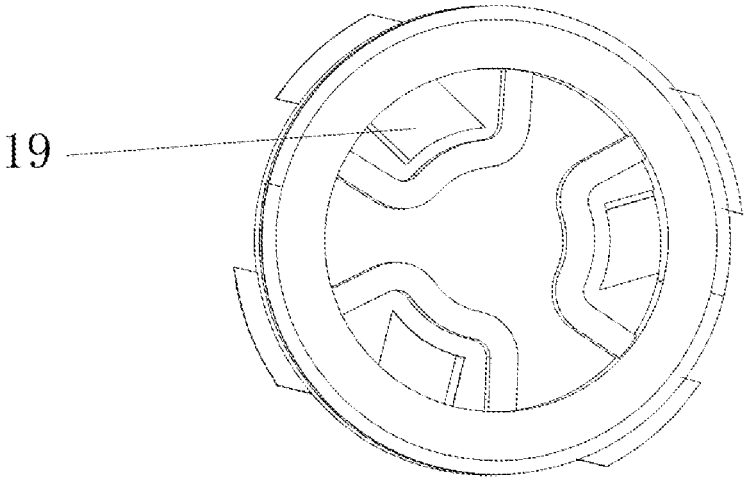
FIG. 8 is a bottom perspective view illustrating the lower swirl outflow member of Embodiment 1 according to the present disclosure.
Figure 9:
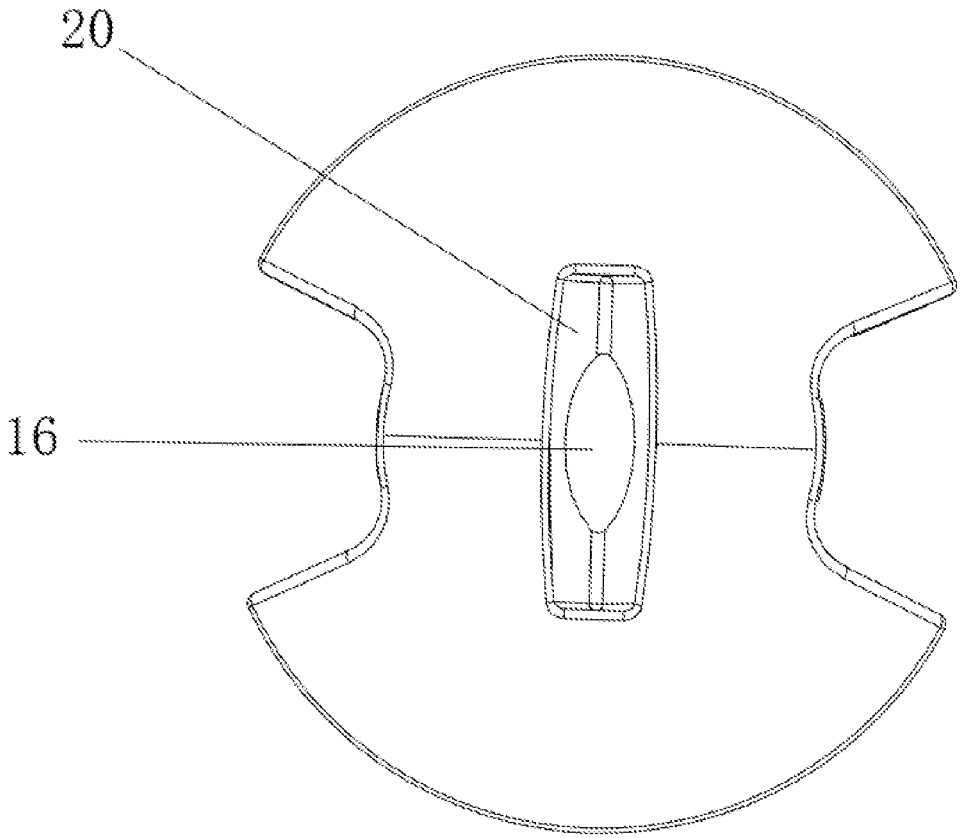
FIG. 9 is a top perspective view illustrating a flushing nozzle of Embodiment 1 according to the present disclosure.

Referring to FIGS. 1-9, as an embodiment of the present disclosure, a rotary cup washing device is provided, including a flushing nozzle 1, a rotary impeller 2, a swirl outflow member 3, a fixed head 4 and a water inlet pipe 7. The flushing nozzle 1, the rotary impeller 2 and swirl outflow member 3 may be all provided in the fixed head 4, the flushing nozzle 1 may be connected to the upper part of the rotary impeller 2, and the lower part of the rotary impeller 2 may be matched with the swirl outflow member 3. The flushing nozzle 1 and the rotary impeller 2 can rotate relative to the fixed head 4 under the water discharge action of the swirl outflow member 3. The lower part of the fixed head 4 may be connected in the water inlet pipe 7, and the water inlet pipe 7 may be connected with a pressure source.

In the above technical solution, the pressure source can be tap water or cleaning liquid, etc. The pressure source transports the tap water into the water inlet pipe 7, and then the water flow flows into the swirl outflow member 3 through the fixed head 4, and then the water flow passes through the swirl outflow member 3 to form a swirl impact flowing to the rotary impeller 2, thereby driving the rotary impeller 2 and the flushing nozzle 1 to rotate together. The rotation stability is higher. At the same time, the rotary impeller 2 can rectify the water flow, and the rectified water flow flows to the flushing nozzle 1. The cup can be sprayed and cleaned evenly in all directions by the flushing nozzle 1, and the cleaning effect is better.

In the present embodiment, the flushing nozzle 1 may be provided with a water outlet channel 14, the top of the flushing nozzle 1 may be provided with a first flushing hole 16 that communicates with the water outlet channel 14. The rotary impeller 2 may be provided with impeller outflow holes 18 corresponding to the water outlet channel 14. The swirl outflow member 3 may be provided with a plurality of swirl outflow holes 19, and the swirl outflow holes 19 may be communicated with the impeller outflow holes 18. The water flow can be formed into a swirl flow through the swirl outflow holes 19, and then flow out through the impeller outflow holes 18 in an orderly manner.

In the present embodiment, a number of baffle blades 15 may be formed on the bottom edge of the rotary impeller 2 at equal intervals in the circumferential direction, so as to ensure that the swirling flow from the swirl outflow member 3 can evenly and stably drive the rotary impeller 2 and the flushing nozzle 1 to rotate together when impacting the baffle blades 15, and at the same time, it is ensured that the water flow from the swirl outflow member 3 can be balanced and rectified, and then flows into the impeller outflow hole 18 and then flows out.

In the present embodiment, the swirl outflow member 3 may be a lower swirl outflow member located under the rotary impeller 2. Three swirl outflow holes 19 may be provided, and the three swirl outflow holes 19 may be evenly distributed at an included angle of 120° in the circumferential direction of the lower swirl outflow member. The swirl outflow holes 19 may be opposite to the bottom side of the baffle blades 15, such that the swirl from the swirl outflow holes 19 can impact the baffle blades 15 from bottom to top, thereby driving the rotary impeller 2 to rotate.

In the present embodiment, a connecting head 5 may be further included. The connecting head 5 may be connected to the fixed head 4 by a thread. The rotary impeller 2 and the swirl outflow member 3 may be limited in the fixed head 4 under the connecting head 5. A seal 6 may be provided between the connecting head 5 and the flushing nozzle 1. Such a configuration can improve the sealing degree and reliability, and at the same time ensure the stable progress of the flushing work.

In the present embodiment, the first flushing hole 16 may be a rugby-shaped through hole provided at the top center of the flushing nozzle 1, and the outer wall of the top center of the flushing nozzle 1 may be formed with a triangular pyramid-shaped recess 20 corresponding to the rugby-shaped through hole. The configuration can make water spray sprayed from the first flushing hole 16 is in the form of a sheet, the flushing coverage area may be larger, and the flushing effect is better.

In the present embodiment, it may also include a set of cup bracket 8 provided outside the fixed head 4. The cup bracket 8 may include a plurality of bearing plates 81 configured for carrying containers such as cups, so as to facilitate positioning and cleaning of the cups. The plurality of bearing plate 81 may be evenly distributed at an included angle of 90° in the circumferential direction of the cup bracket 8, and a certain interval may be provided between two adjacent bearing plates 81, such that it is convenient for the cup to be picked up and taken out after cleaning. The upper surface of the bearing plate 81 of the cup bracket 8 may be provided with a number of annular ridges 82 adapted to cups with different sizes of cup mouths. Of course, the annular ridges 82 can also be used to clean containers such as buckets, bottles, and any hollow parts.

Specifically, a base 10 may be also included, the base 10 may be sleeved and installed outside the water inlet pipe 7 and located below the cup bracket 8, and may be used for discharging and treating the cleaned sewage.

In the present embodiment, a water control mandrel 9 may be also included. The water control mandrel 9 may be connected to the lower part of the fixed head 4, and provided with a water channel 13. An annular protrusion 71 may be formed in the water inlet pipe 7. The annular protrusion 71 divides the interior of the water inlet pipe 7 into a receiving channel 11 and a water inlet channel 12. The water control mandrel 9 runs through the annular protrusion 71. The end of the water control mandrel 9 located on the water inlet channel 12 may be a block end 91 blocked and matched with the annular protrusion 71; the water control mandrel 9 may be further provided with a water hole communicating with the water channel 13 above the block end 91; the water control mandrel 9 located between the fixed head 4 and the annular protrusion 71 may be further provided with a spring 22 outside. In an initial state, the block end 91 is blocked and matched with the annular protrusion 71, the water hole 21 is located in the receiving channel 11, and the water hole 21 is not communicated with the water inlet channel 12. When the cup is placed on the cup bracket 8 and pressed down to move, the spring 22 may be compressed, the cup bracket 8, the fixed head 4 and the water control mandrel 9 may move down together. The block end 91 may be separated from the annular protrusion 71, and the water hole 21 moves down through the annular protrusion. At this time, the water hole 21 is located in and communicates with the water inlet channel 12, the water path of the rotary cup washing device is opened, and the cup is cleaned. When the cup is taken out after cleaned, the spring 22 may be elastically reset. The cup bracket 8, the fixed head 4, and the water control mandrel 9 will also move upward and automatically reset under the elastic force of the spring 22. At this time, the block end 91 moves upward to cooperate blocking with the annular protrusion 71, and the water path of the rotary cup washing device is closed.

Embodiment 2

Figure 10:
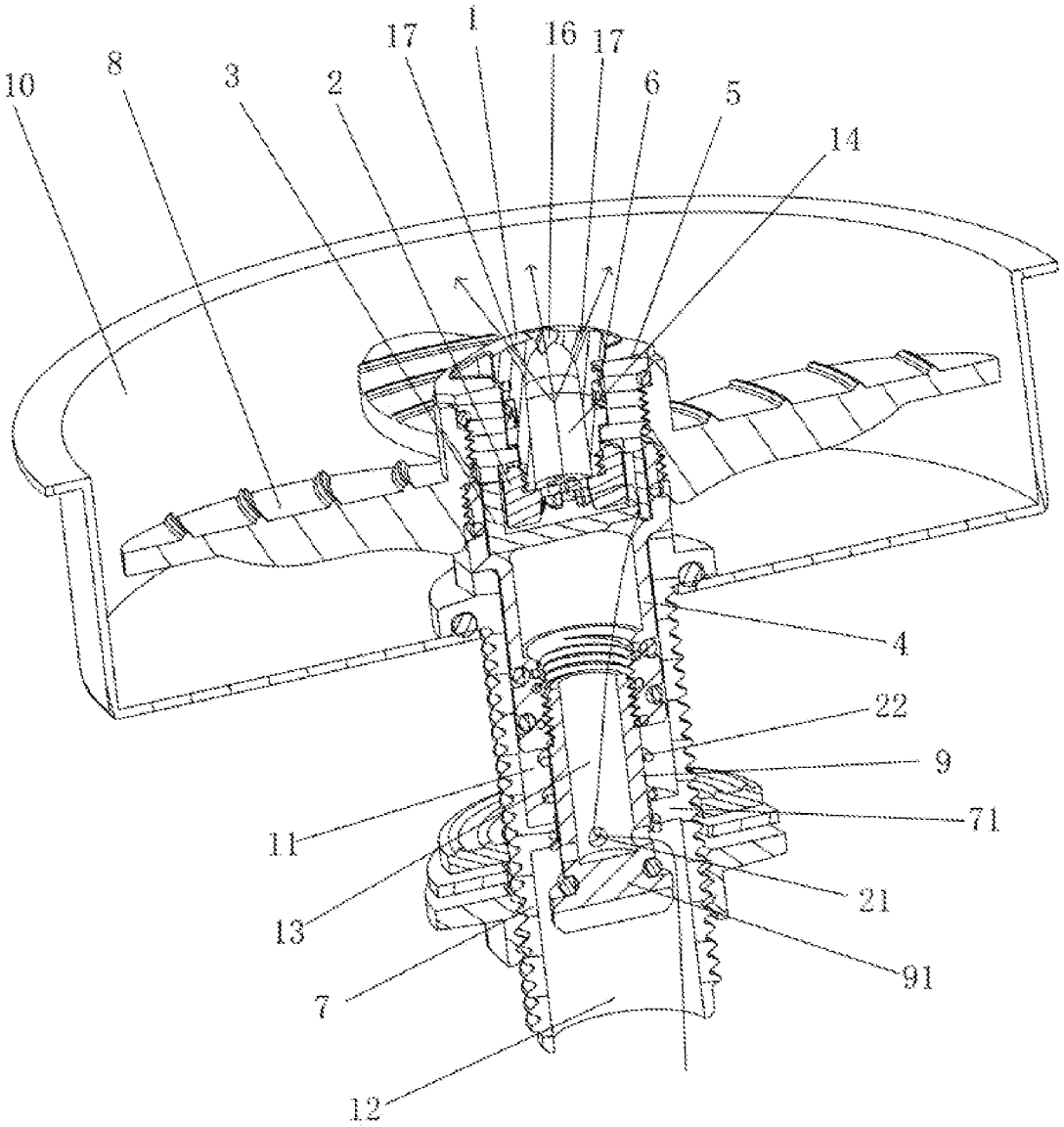
FIG. 10 is a cross-sectional view of Embodiment 2 according to the present disclosure (the line path in the figure is the water outlet path)
Figure 11:
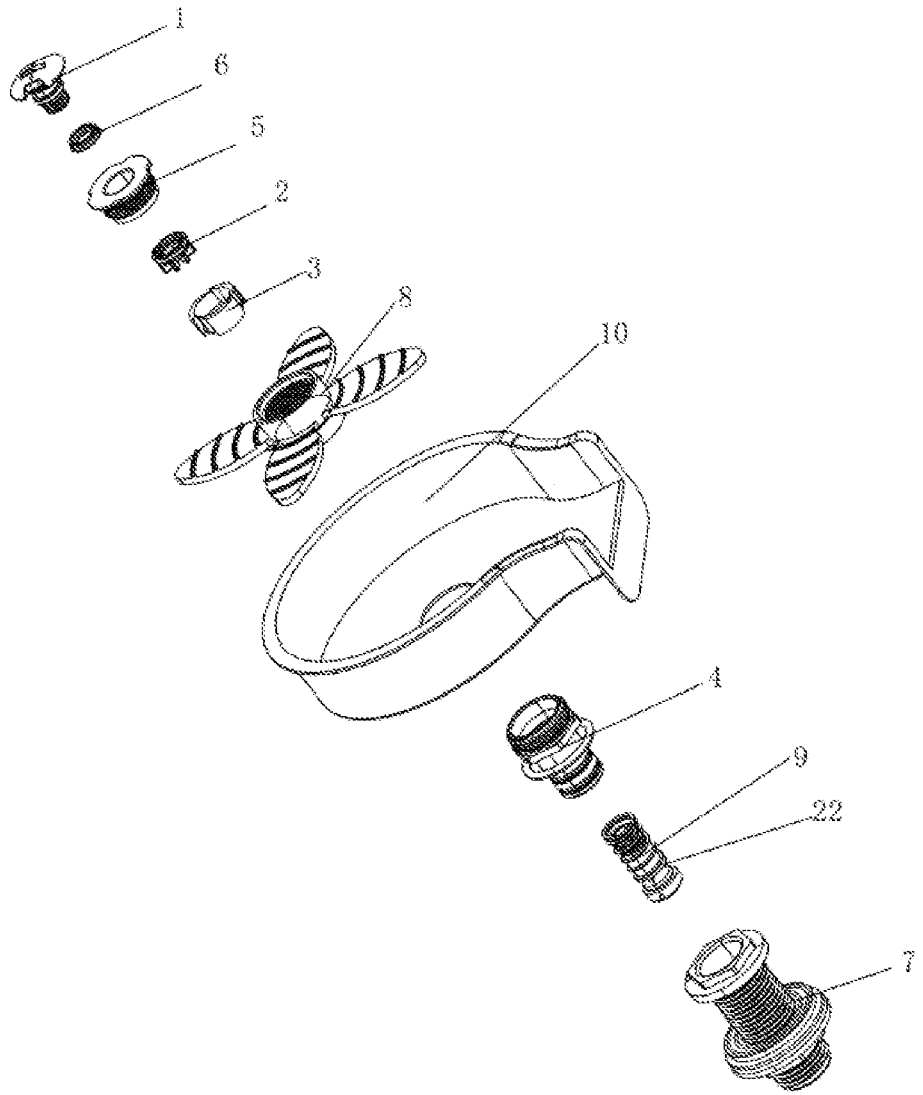
FIG. 11 is an exploded view of Embodiment 2 according to the present disclosure.
Figure 12:
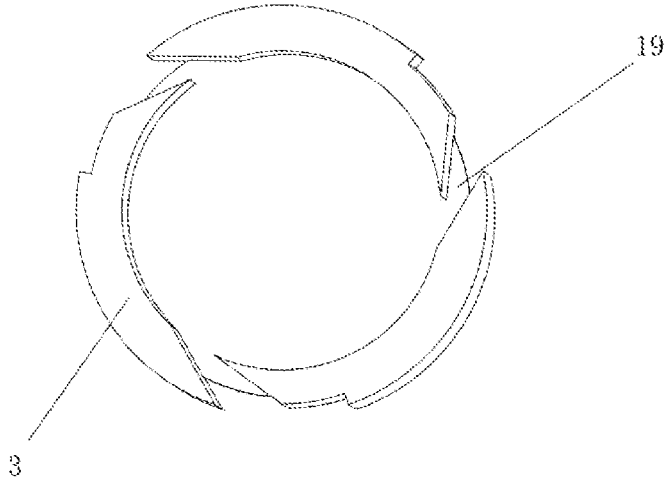
FIG. 12 is a top perspective view illustrating a peripheral swirl outflow member of Embodiment 2 according to the present disclosure.
Figure 13:
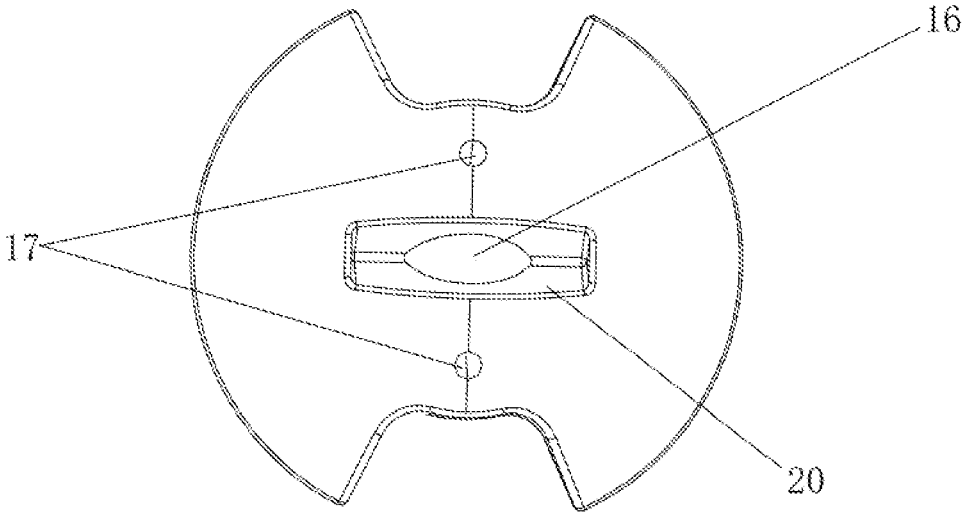
FIG. 13 is a top perspective view illustrating a flushing nozzle of Embodiment 2 according to the present disclosure.

For the sake of brevity, the present embodiment only describes the difference from Embodiment 1:

Referring to FIGS. 10-13, in the present embodiment, the swirl outflow member 3 may be a peripheral swirl outflow member in a shape of a bottle cap and sleeved on the outer bottom of the rotary impeller 2. There may be three swirl outflow holes 19 provided. The swirl outflow holes 19 may be evenly distributed at an included angle of 120° in the circumferential direction outside the peripheral swirl outflow member. The swirl outflow holes 19 may be opposite to the outsides of the baffle blades 15, such that the swirl flow from the swirl outflow holes 19 can impact the baffle blades 15 from the outside to the inside, thereby driving the rotary impeller 2 to rotate.

In the present embodiment, the top of the flushing nozzle 1 may be respectively provided with second flushing holes 17 communicating with the water outlet channel 14 on both sides of the first flushing holes 16, and the second flushing holes 17 may be provided obliquely outward, such that the flushing space can be further increased, with a stronger impact and higher cleanliness.

Embodiment 3

Figure 14:
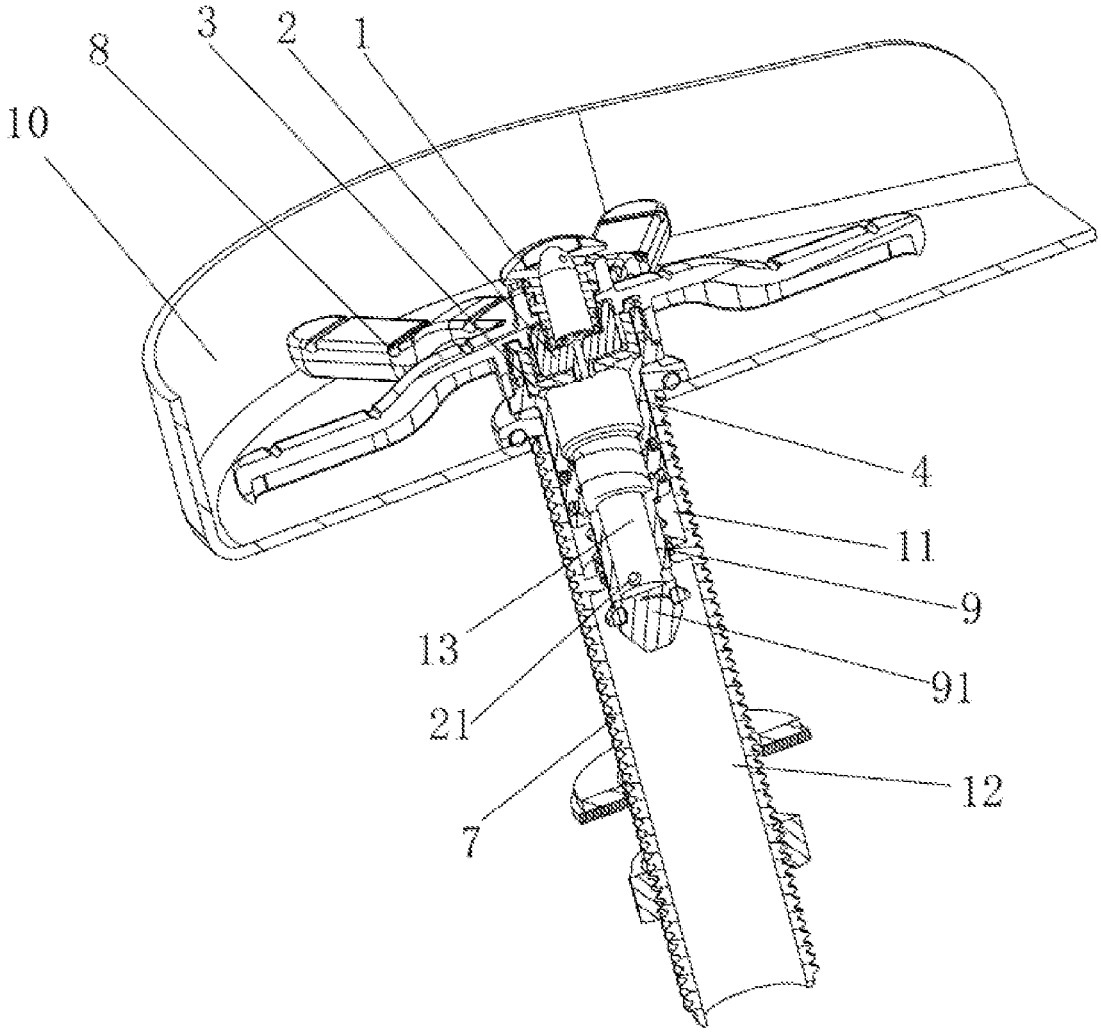
FIG. 14 is a cross-sectional view of Embodiment 3 according to the present disclosure.
Figure 15:
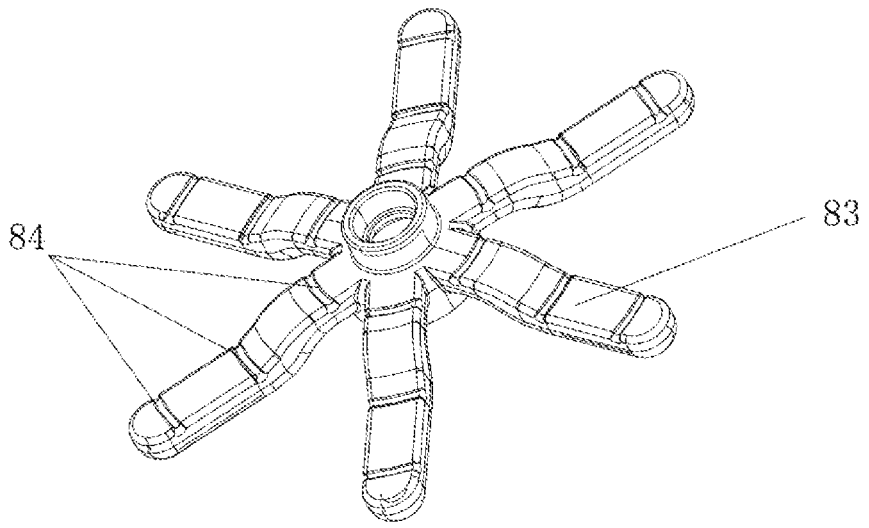
FIG. 15 is a schematic view of a cup bracket of Embodiment 3 according to the present disclosure.
Figure 16:
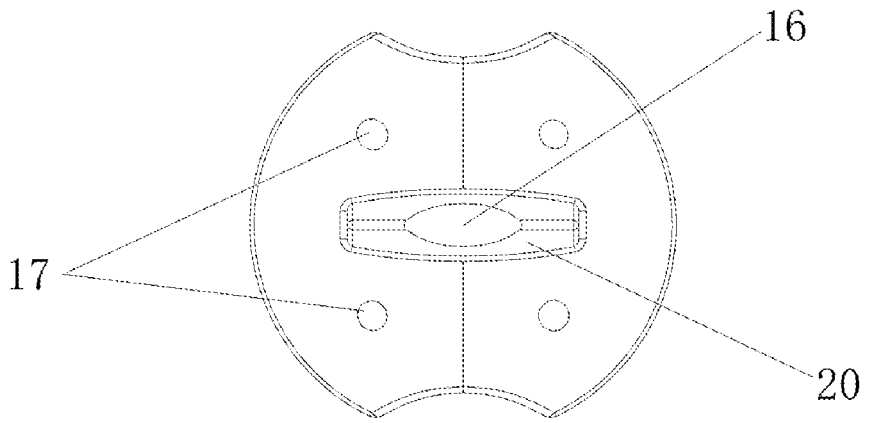
FIG. 16 is a top perspective view illustrating a flushing nozzle of Embodiment 3 according to the present disclosure.
Figure 17:
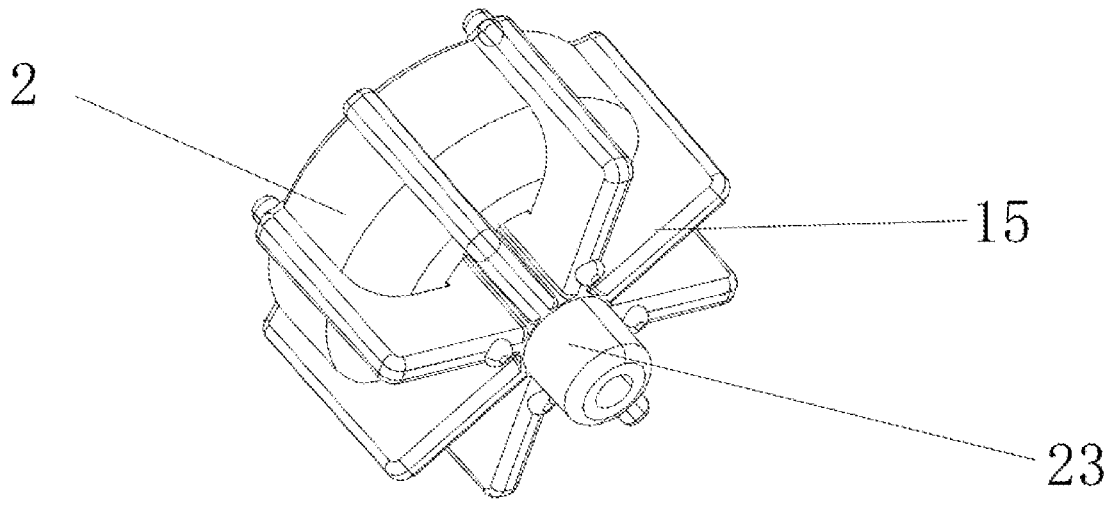
FIG. 17 is a bottom perspective view illustrating a rotary impeller of Embodiment 3 according to the present disclosure.
Figure 18:
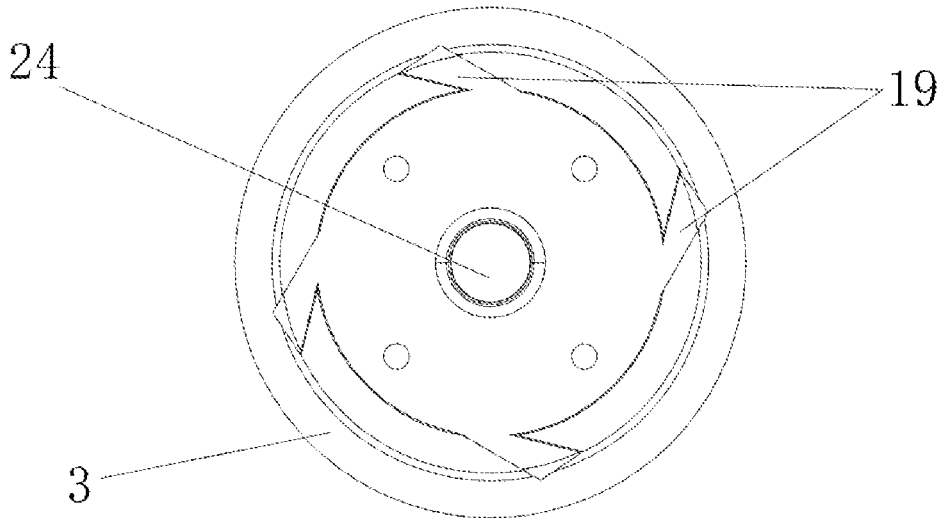
FIG. 18 is a top view of the swirl outflow member of Embodiment 3 according to the present disclosure.

For the sake of brevity, the present embodiment only describes the difference from Embodiment 2:

Referring to FIGS. 14-18, in the present embodiment, the fixed head 4 and the water control mandrel 9 may be integrally formed to ensure the connection strength and water-out stability. The cup bracket 8 may include a plurality of bearing rods 83 for carrying the container such as cup etc., such that it is convenient for positioning and cleaning the cup. The plurality of bearing rods 83 may be evenly distributed in the circumferential direction of the cup bracket 8, and there may be a certain interval between two adjacent bearing rods 83, such that it is convenient to take out the cup after cleaned. A plurality of annular grooves 84 may be provided on the upper surfaces of the bearing rods 83 of the cup bracket 8 for adapting to cups of different sizes.

In the present embodiment, the top of the flushing nozzle 1 may be located on both sides of the first flushing hole 16 and may be respectively provided with second flushing holes 17 communicating with the water outlet channel 14. The number of the second flushing holes 17 may be 4, and they may be provided obliquely outwards, which further increases. The flushing space may be increased, the impact may be stronger, and the cleanliness may be higher.

In the present embodiment, a hollow column 23 may extend downward from the bottom center of the rotary impeller 2, a through hole 24 may be formed in the middle of the swirl outflow member 3. The hollow column 23 may be butt-fitted with the through hole 24, such that the rotary impeller 2 can be stably installed with the swirl outflow member 3, and matched to ensure the stability of the water outlet.

The workflow of the present disclosure may be as follows: The water inlet pipe 7 is connected with a pressure source such as tap water. After the tap water is opened, the cup is placed upside down on the cup bracket 8 and pressed down with the palm to overcome the elastic force of the spring 22 and the pressure of the tap water, such that the fixed head 4 and the water control mandrel 9 can move downward together, such that the water hole 21 passes through the annular protrusion 71 and communicates with the water inlet channel 12. The water flow in the water inlet channel 12 flows into the water channel 13 through the water hole 21, and then flows into the swirl outflow holes 19 of the swirl outflow member 3 through the fixed head 4. The water flow can form a swirl impacting to the baffle blades 15 through the swirl outflow holes 19, thereby driving the rotary impeller 2 and the flushing nozzle 1 to rotate together, while the baffle blades 15 can also rectify the water flow. The rectified water flow flows through the impeller outflow holes 18 to the water outlet channel 14, and finally flows out through the first flushing hole 16 and the second flushing hole 17 to rotate, clean the cup thoroughly. After the cup is taken out after being rinsed, under the elastic force of the spring 22, the fixed head 4 moves upward together with the water control mandrel 9 for automatic reset, the water hole 21 moves upward and returns to the receiving channel 11. The annular protrusion 71 is blocked upwardly by the block end 91, and the water path is automatically closed.

Although the present disclosure has been specifically shown and described in connection with the preferred embodiments, it will be understood by those skilled in the art that the various changes made by the present disclosure all fall into the protection scope of the present disclosure.

What is claimed is:

1. A rotary cup washing device, comprising a flushing nozzle, a rotary impeller, a swirl outflow member, a fixed head and a water inlet pipe, wherein:

the flushing nozzle, the rotary impeller and the swirl outflow member are all provided in the fixed head, the flushing nozzle is connected to an upper part of the rotary impeller, a lower part of the rotary impeller is correspondingly matched with the swirl outflow member, the flushing nozzle and the rotary impeller are configured to rotate relative to the fixed head under a water discharge action of the swirl outflow member, a lower part of the fixed head is connected to the water inlet pipe, and the water inlet pipe is connected to a pressure source.

2. The rotary cup washing device according to claim 1, wherein:

the flushing nozzle is provided with a water outlet channel, a top of the flushing nozzle is provided with a first flushing hole in communication with the water outlet channel, the rotary impeller is provided with impeller outflow holes corresponding to the water outlet channel, the swirl outflow member is provided with a plurality of swirl outflow holes, and the plurality of swirl outflow holes are in communication with the impeller outflow holes.

3. The rotary cup washing device according to claim 2, wherein:

the first flushing hole is a rugby-shaped through hole provided at a top center of the flushing nozzle, and an outer wall of the top center of the flushing nozzle is formed with a triangular pyramid-shaped recess corresponding to the rugby-shaped through hole.

4. The rotary cup washing device according to claim 3, wherein:

the top of the flushing nozzle is provided with second flushing holes respectively on both sides of the first flushing hole and in communication with the water outlet channel, and the second flushing holes are inclined outward.

5. The rotary cup washing device according to claim 1, wherein a bottom edge of the rotary impeller is provided with a plurality of baffle blades formed at equal intervals in a circumferential direction.

6. The rotary cup washing device according to claim 5, wherein:

the swirl outflow member is a lower swirl outflow member located under the rotary impeller, three swirl outflow holes are provided, the three swirl outflow holes are evenly distributed at an included angle of 120° in the circumferential direction inside a bottom of the lower swirl outflow member, and the three swirl outflow holes are opposite to bottoms of the plurality of baffle blades.

7. The rotary cup washing device according to claim 5, wherein:

the swirl outflow member is a peripheral swirl outflow member in a shape of a bottle cap and sleeved on an outer bottom of the rotary impeller, three swirl outflow holes are provided, the three swirl outflow holes are evenly distributed at an included angle of 120° in the circumferential direction outside the peripheral swirl outflow member, and the three swirl outflow holes are opposite to outsides of the plurality of baffle blades.

8. The rotary cup washing device according to claim 1, further comprising a connecting head connected in the fixed head, wherein the rotary impeller and the swirl outflow member are constricted from movement in the fixed head under the connecting head.

9. The rotary cup washing device according to claim 1, further comprising a set of cup brackets provided outside the fixed head, wherein:

the set of cup brackets comprises a plurality of bearing plates, and upper surfaces of the plurality of bearing plates of the set of cup brackets are provided with a plurality of annular ridges.

10. The rotary cup washing device according to claim 1, further comprising a water control mandrel connected to the lower part of the fixed head and provided with a water channel, wherein:

the water inlet pipe is formed with an annular protrusion, an inside of the water inlet pipe is divided into a receiving channel and a water inlet channel by the annular protrusion, the water control mandrel runs through the annular protrusion, one end of the water control mandrel at the water inlet channel is a block end blocked and mated with the annular protrusion, the water control mandrel located on the block end is further provided with a water hole in communication with the water channel, and the water control mandrel located between the fixed head and the annular protrusion is further sleeved with a spring outside the water control mandrel.

11. The rotary cup washing device according to claim 10, wherein the fixed head and the water control mandrel are integrally formed.

* * * * *